US009108235B2

(12) United States Patent
Kipping et al.

(10) Patent No.: US 9,108,235 B2
(45) Date of Patent: Aug. 18, 2015

(54) METHOD AND DEVICE FOR COOLING ROLLS

(71) Applicant: SMS Siemag AG, Duesseldorf (DE)

(72) Inventors: Matthias Kipping, Herdorf (DE); Ralf Seidel, Dillenburg (DE); Johannes Alken, Siegen (DE)

(73) Assignee: SMS Siemag AG, Duesseldorf (DE)

( * ) Notice: Subject to any disclaimer, the term of this patent is extended or adjusted under 35 U.S.C. 154(b) by 0 days.

(21) Appl. No.: 14/367,271

(22) PCT Filed: Nov. 29, 2012

(86) PCT No.: PCT/EP2012/073900

§ 371 (c)(1),
(2) Date: Jun. 20, 2014

(87) PCT Pub. No.: WO2013/092152

PCT Pub. Date: Jun. 27, 2013

(65) Prior Publication Data

US 2015/0013405 A1 Jan. 15, 2015

(30) Foreign Application Priority Data

Dec. 23, 2011 (DE) ..... 10 2011 089 804
Feb. 16, 2012 (DE) ..... 10 2012 202 340

(51) Int. Cl.
*B21B 27/10* (2006.01)
*B21B 38/00* (2006.01)

(52) U.S. Cl.
CPC ..... *B21B 27/10* (2013.01); *B21B 38/00* (2013.01); *B21B 2027/103* (2013.01)

(58) Field of Classification Search
CPC .... B21B 27/10; B21B 38/00; B21B 2027/103
USPC ..... 72/6.2
See application file for complete search history.

(56) References Cited

U.S. PATENT DOCUMENTS

| | | | | |
|---|---|---|---|---|
| 4,741,193 | A | 5/1988 | Tomoaki | |
| 5,628,223 | A | 5/1997 | Denker | |
| 6,006,574 | A | 12/1999 | Armenat | |
| 6,142,003 | A | 11/2000 | Plociennik | |
| 8,281,632 | B2 * | 10/2012 | Uijtdebroeks et al. | 72/201 |

(Continued)

FOREIGN PATENT DOCUMENTS

| | | |
|---|---|---|
| EP | 919297 A2 | 6/1999 |
| JP | 54-82348 | 6/1979 |
| JP | 62-45409 | 2/1987 |

(Continued)

*Primary Examiner* — David B Jones
(74) *Attorney, Agent, or Firm* — Abelman, Frayne & Schwab

(57) ABSTRACT

The invention relates to a method for cooling a roll (1), in particular a working roll (1) of a hot-rolling system, comprising the steps of feeding coolant (3) by means of a nozzle (5) into a gap (7) between at least a portion of the roll surface and a cooling shell (9, 11) that can be placed against the portion of the roll surface, and adjusting the gap height (h) between the cooling shell (9, 11) and the roll surface. According to the invention, the adjustment of the gap height (h) comprises either measuring the pressure ($p_{act}$) of the fed coolant (3) or measuring the volumetric flow rate ($V_{act}$) of the fed coolant (3). The invention further relates to a corresponding device (10) for cooling a roll (1).

14 Claims, 4 Drawing Sheets

(56) References Cited

U.S. PATENT DOCUMENTS

| | | | | |
|---|---|---|---|---|
| 8,978,437 | B2 * | 3/2015 | Malas et al. | 72/201 |
| 2012/0031159 | A1 | 2/2012 | Seidel | |

FOREIGN PATENT DOCUMENTS

| | | |
|---|---|---|
| JP | 62-68612 | 3/1987 |
| JP | 02-25206 | 1/1990 |
| JP | 02-241604 | 9/1990 |
| JP | 02-241605 | 9/1990 |
| JP | 02-290605 | 11/1990 |
| JP | 03-161105 | 7/1991 |
| JP | 05-317927 | 12/1993 |
| JP | 05-329515 | 12/1993 |
| JP | 06-15313 | 1/1994 |
| JP | 06-15315 | 1/1994 |
| JP | 08-24914 | 1/1996 |
| JP | 09-085313 | 3/1997 |
| JP | 10-5827 | 1/1998 |

* cited by examiner

METHOD AND DEVICE FOR COOLING ROLLS

RELATED APPLICATIONS

This is a National stage application of International Application PCT/EP2012/073900 filed Nov. 29, 2012, designating the United States of America, and claiming priority of German applications DE 10 2011 089 804.2 filed Dec. 23, 2011 and DE 10 2012 202 340.2 filed Feb. 16, 2012, all of the three applications are incorporated herein by reference thereto.

FIELD OF THE INVENTION

The present invention relates to cooling of rolls, in particular, of work rolls in a rolling mill, with a cooling fluid.

STATE-OF-THE ART

State-of-the art describes current cooling when water or coolant flows between a cooling shell and a roll. Often, when such systems are used, it is possible to adjust the gap between a work roll and a cooling shell. In particular, the work rolls have, as a rule, a ground down region so that the cooling shell can be adapted to the work roll curvature. In addition, the work rolls can occupy different positions in a rolling mill stand. These positions depend, e.g., on the thickness of the incoming rolling stock and the predetermined pass reduction.

In a rolling mill, dependent on the temperature of the rolling stock and the desired formability, a varied amount of heat energy is introduced into the roll. In order to achieve an adequate cooling, the gap between the cooling shell and the roll should be controlled. It is desirable that the cooling medium passes the roll surface with a high velocity to effectively cool the roll. In order to press the cooling medium through the gap, a corresponding pressure is needed. From the general state-of-the art, it is known that the height of the gap can be measured with distance sensors. The drawbacks of such distance measurement, which is rather common, consists in that the measurement of the distance in the flow between the cooling shall and the roll surface is difficult and imprecise. If the distance, alternatively, is measured indirectly, e.g., by measuring the displacement path of a piston for placing the cooling shell on the roll surface, measurement imprecisions and, thus, mounting errors, likewise can take place. In particular, in this case, the actual roll position may not be known, so that at short-duration jumps of a roll that take place, the control cannot properly react.

An error in mounting of a cooling shell on a roll can lead to damage as a result of collision of the roll and the cooling shell, or to the overheating of the roll. The roll overheating can lead to damage of the roll or reduction of quality of a rolled strip.

The many known position sensors have a drawback that consists in that they do not sufficiently reliable under rolling mill conditions. Thus, optical sensor, e.g., can become soiled and, therefore, supply an erroneous information or completely break down. The same applies to inductive sensors.

The object of the invention is to provide improved, in particular, reliable and robust systems for setting of a cooling shell on a roll surface.

A further object of the invention is to overcome at least one of the above-mentioned drawbacks.

DESCRIPTION OF THE INVENTION

The above-mentioned objects are achieved by features of claim 1 directed to a method of cooling a roll, in particular a work roll of a hot rolling installation. The method includes feeding of a coolant with a nozzle in a gap between at least a portion of the roll surface and a cooling shell mountainable on the portion of the roll surface, and adjusting or controlling the gap height between the cooling shell and the roll surface. The adjustment or control is carried out, according to the invention, either based on the measurement of the coolant pressure or on the measurement of the volume flow rate of the fed coolant. In other words, either the coolant pressure or the volume flow rate of the coolant is an indicator of the gap height.

The inventive method not only does not rely on an error-prone height measurement between the cooling shell and the roll surface but permits a precise determination of the gap height dependent on the coolant pressure or the coolant volume flow rate. The inventive method permits to automatically take into account the changing of the position of the roll.

According to a further advantageous embodiment, the adjustment or control includes increase of the distance (the gap height) between the roll and the cooling shell when the measured coolant pressure or the volume flow rate are above a predetermined upper threshold. This counteracts, in particular, to the collision of the roll with the cooling shell. It is also possible to use the increase above the upper threshold for emergency shut down of the installation to prevent any damage and an extended down time as well as the production losses.

According to a still further advantageous embodiment of the invention the distance (the gap height) between the roll and the cooling shell is reduced when the measured coolant pressure or the volume flow rate of the coolant is a below the lower threshold.

The setting of the distance or the gap height can be carried out with adjustment devices known to one of ordinary skill in the art, e.g., (hydraulic or mechanical) piston-cylinder units. However, other electrical, mechanical, or electromechanical adjustment devices can be used.

According to a yet further, advantageous embodiment, the coolant is fed to the nozzle (and, thus, into the gap), with a known or predetermined volume flow rate. The setting or control of the distance between the roll and the cooling shell is carried out in accordance with the measurement of the coolant pressure based on a preliminary obtained pressure-distance characteristic for the predetermined volume flow rate of the coolant.

In another case, it is possible to feed the coolant to the nozzle (and, thus, into the gap) with a known or predetermined coolant pressure, wherein the setting or control of the distance between the roll and the cooling shell is carried out in accordance with measurement of the volume flow rate based on a preliminary obtained volume flow rate-distance characteristic for the predetermined pressure of the coolant.

According to another advantageous embodiment of the invention, the volume flow rate of the fed coolant is kept constant, and the measured coolant pressure is compared with a set gap height based on the corresponding pressure-distance characteristic corresponding to a constantly held volume flow rate. Preferably, the control deviation produced by this comparison, is used as an adjustment value for setting or adjustment of the gap height.

According to yet another advantageous embodiment of the invention, the pressure of the fed coolant is kept constant, and the measured volume flow rate is compared with the set height of the gap based on the corresponding volume flow rate-distance characteristic corresponding to the constantly kept pressure. Preferably, the deviation produced by this comparison is used as a control variable for setting the gap height.

According to still another advantageous embodiment of the invention, an actual coolant pressure is measured with a pressure sensor and with the aid of a pressure-distance characteristic, is associated with an actual gap height. The coolant volume flow rate, which corresponds to the used pressure-distance characteristic, is kept constant. The actual gap height is compared with a predetermined set gap height. The difference of this comparison is advantageously communicated to a controller. Dependent on the magnitude of the deviation, then, the gap height (by generation of a control variable) is adjusted.

According to a further advantageous embodiment of the invention, the actual coolant pressure is measured with a pressure sensor. The coolant volume flow rate is kept constant. A predetermined set gap height is associated, with the aid of a pressure-distance characteristic that corresponds to the constantly kept volume flow rate, with a corresponding set pressure. The set pressure is compared with the measured actual coolant pressure.

The difference of this comparison is advantageously communicated to a controller. Dependent on the magnitude of the deviation, then, the gap height (by generation of a control variable) is adjusted.

According to another further advantageous embodiment of the invention, the actual volume flow rate is measured with a volume flow rate meter and is associated, with, with the aid of a volume flow rate-distance characteristic, with an actual gap height. The coolant pressure that corresponds to the used volume flow-rate characteristic, is kept constant. The actual gap height is compared with the predetermined set gap height.

The difference resulting from this comparison is communicated advantageously to a controller. This one generates a control variable for an adjustment device that adjusts the gap height.

According to yet another further embodiment of the present invention, an actual volume flow rate is measured with a volume flow rate meter. The coolant pressure is kept constant. A predetermined set gap height is associated, with the aid of a volume flow rate-distance characteristic that corresponds to the constantly kept coolant pressure, with a set volume flow rate. This volume flow rate is compared with the measured actual volume flow rate.

The difference resulting from this comparison is communicated advantageously to a controller. This one generates a control variable for an adjustment device that adjusts the gap height. In other words, the difference serves as a value for adjusting the gap height.

The characteristic can, e.g., be obtained experimentally or by a numerical simulation.

According to a still further embodiment of the method, the characteristic (in case of measuring the pressure) is produced for a number of different volume flow rates (at least two) in particular for at least one predetermined set pressure, for cooling the roll. In case of measuring the volume flow rate of the coolant, it is also possible to produce characteristics for a number of different pressures (at least two), in particular for a predetermined flow rate of a coolant fed for cooling the roll.

According to another embodiment of the method, the characteristic is produced by association of the coolant pressure with the gap height between the roll surface and the cooling shell. In case of measuring volume flow rate, the characteristic is produced by association of the volume flow rate with the gap height between the roll surface and the cooling shell.

The coolant pressure or the volume flow rate associated with the gap height, is given or determined at a point where the measurement of the pressure or the volume flow rate takes place. The measuring of the pressure and the volume flow rate takes place advantageously in the nozzle region, in particular, in the nozzle, e.g., in the nozzle inlet.

The invention further includes a device for cooling a work roll, preferably for carrying a method according to one of the preceding claims, wherein the device includes a cooling shell mountable on the roll and having a shape substantially complementary to a region of the roll surface, and extending at least over portion of the axial width of the roll and at least over a portion of the circumference of the roll. The device further includes a nozzle for feeding the coolant in a gap between the cooling shell and the roll and a pressure sensor for measuring the coolant pressure, preferably in a region of the nozzle and a controller device for setting or controlling a gap height between the cooling shell and the roll dependent on the coolant pressure measured by the pressure sensor. Alternatively, the device can include a volume flow meter (or sensor) for measuring the coolant volume flow rate, preferably in a region of the nozzle, and a device for setting or controlling a gap height between the cooling shell and the roll dependent on the volume flow rate measured by the volume flow meter.

Further, the present invention also includes a coolable rolling device, preferably for carrying out the above-described method and having a roll for rolling a metal strip and the above-described device for cooling the roll.

According to a further embodiment of the invention, the nozzle injects the coolant essentially parallel to the circumferential direction or tangentionally to the roll. The light mass of the nozzle can generally narrow toward the roll surface, i.e., from nozzle inlet to nozzle outlet. Further, the nozzle can narrow from the nozzle inlet to the nozzle outlet, with simultaneous inclination of coolant flow, in the direction tangentionally to the roll surface. The nozzle or the nozzle outlet can generally be formed by a slot extending parallel to the roll axis. Alternatively, a plurality of nozzles for feeding coolant and extending parallel to the roll axis can be provided.

According to yet a further embodiment of the invention, the flow direction of the coolant in the gap is opposite to a rotational direction of the roll. Thereby, the heat transfer from the rod to the cooling medium is further increased by increase of the relative speed between the roll and the coolant.

In another advantageous embodiment of the invention, the nozzle is arranged, with reference to the flow direction of the coolant, in the gap at a remote end of the cooling shell.

Generally, the nozzle is formed as an integral component of the cooling shell, or is formed therein, or is separately inserted in an opening in the cooling shell. Alternatively, the nozzle can be arranged separately at an end of the cooling shell in the circumferential direction of the roll. The nozzle can also, e.g., be formed by a pipe or a hose.

According to a still further embodiment of the invention, a stripper for stripping the coolant from the roll surface is arranged at the remote end of the cooling shell so that only a small amount of coolant reaches the metal strip.

In a further embodiment of the invention, the cooling shell is adjusted on the roll surface by tilting the cooling shell and/or by a translational movement of the cooling shell.

According to a yet further embodiment of the invention, the cooling shell viewed in the circumferential direction of the roll is formed of at least two parts, wherein both parts of the cooling shell pivot relative to each other about an axis extending parallel to an axial direction of the roll.

It is also possible to form the cooling shell, in the circumferential direction, of several parts with adjacent parts being (respectively) pivotally connected with each other, so that the cooling shell can be better adapted to the roll circumference.

The features of the above-described embodiments can be combined with each other or be replaced for one another.

BRIEF DESCRIPTION OF THE DRAWINGS

Below, the drawing figures of the embodiment will be shortly described. Further details would become apparent from the detailed description of the embodiments. The drawings show.

DETAILED DESCRIPTION OF THE PREFERRED EMBODIMENTS

Figure 1:
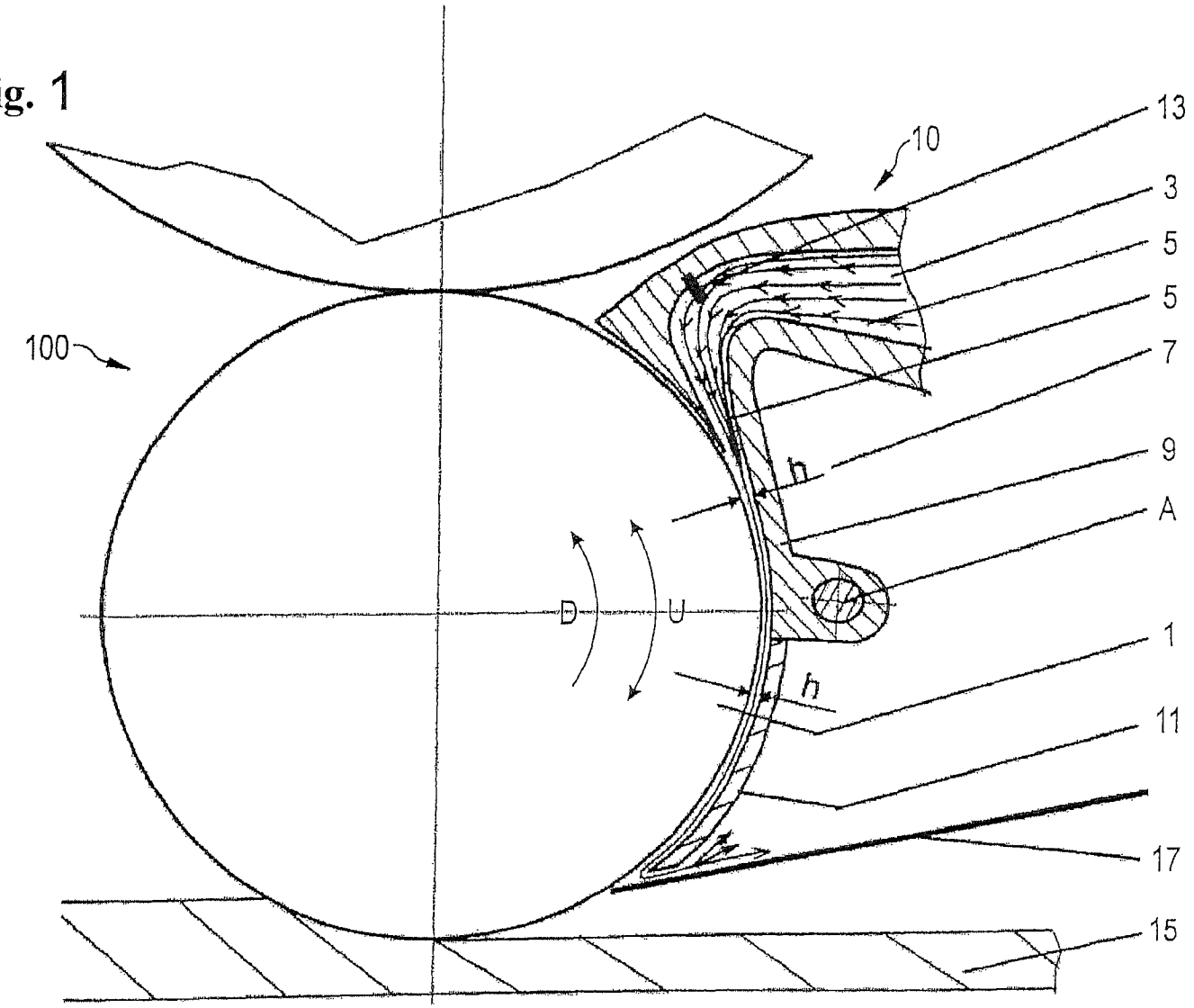
FIG. 1 a schematic cross-sectional view of a device for cooling a roll according to an embodiment of the invention.

FIG. 1 shows a device according to the invention for cooling a work roll 1. The device 10 includes a cooling shell 9, 11 that has an essentially complementary shape to at least a portion of the roll circumference U. The cooling shell 9, 11 is adjusted on the roll by an adjustment device (not shown) and can extend over at least a partial region of the axial roll width in the axial direction of the roll 1. Between the roll surface and the cooling shell 9, 11, a gap 7 is formed the height h of which is adjusted by the device 10 in a control manner. In other words, the distance h between the cooling shell 9, 11 and roll 1 is formed so that it is adjustable. During operation of the device, the gap height can lie in a range between 0.1 cm and 2.5 cm and, preferably, between 0.2 cm and 1 cm.

The roll 1 rotates in a rotational direction D, applying a force to a to-be-rolled strip 15. On the side remote from the strip 15, the work roll 1 can be supported by at least one further roll.

Between the roll 1 and the cooling shell 9, 11, coolant 3 can be injected in the gap 7 by a nozzle 5. Advantageously, the coolant 3 flows almost completely through the gap 7 for cooling the roll 1. The nozzle 5 can be formed, as shown, in the body of the cooling shell 9, 11. Advantageously, the nozzle 5 directs the coolant 3 in the gap 7 in a direction opposite the roll rotational direction D. Advantageously, the flow direction follows essentially parallel or tangentially to the circumference U of the roll 1. The term "circumference" should not be understood as limited only to a term "orientation," but rather as describing a direction which is defined by the surface curvature of the roll 1. Further, the nozzle 5 can have a narrowing profile in a downstream direction. E.g., the nozzle can narrow from a size corresponding to about from 5 to 20 times of the gap height to a size corresponding approximately from 0.5 to 3 times of the gap height.

Advantageously, the coolant 3 flows in the nozzle 5 with a predetermined flow rate $V_x$. The pressure p of the coolant 3 can advantageously be measured in the region of the nozzle 5, i.e., e.g., in the narrowing region of the nozzle 5 between the nozzle inlet and nozzle outlet. Generally, the pressure measurement can be carried out with a suitable pressure sensor 13 familiar to one of ordinary skill in the art.

It is also possible to direct the cooling medium 3 in the nozzle 5 with a predetermined pressure p. The volume flow rate of the coolant 3 can advantageously be measured in the region of the nozzle 5, i.e., e.g., in the narrowing region of the nozzle 5 between the nozzle inlet and nozzle outlet. Generally, the pressure measurement can be carried out with a suitable volume flow rate meter 13 familiar to one of ordinary skill in the art. Naturally, both types of sensors can be used as long as both of the measurements of the pressure at a known or predetermined volume flow rate or the measurement of the volume flow rate at a known or predetermined pressure can be alternatively carried out.

It is not absolutely necessary that the nozzle 5 forms an integral part of the cooling shell 9, 11. The nozzle 5 can be separately inserted in an opening of the cooling shell 9 or adjoin the cooling shell 9, 11 at an end that lies in the circumferential direction U of the cooling shell 9, 11.

The cooling shell 9, 11 can further be formed as a multipart element. In particular, the cooling shell can have, in the circumferential direction U, several items pivotable about an axis A extending parallel to the roll axis. With one or more axes A along the circumferential direction U, the positioning of the cooling shell with respect to rolls having different diameters can be better carried out.

Advantageously, a stripper 17 (e.g., of metal, wood, or hard fabric) can be provided at the end of the gap 7 opposite the flow direction of the coolant 3 or at the end of the gap 7 that is closest to the to-be-rolled strip 15. Thereby, contact of the coolant 3 with the strip 15 is almost excluded. The stripper 17 can, e.g., be formed as a plate positioned along one of its edges, on the circumference of the roll 1. It is also possible to displace the stripper 17 directly or indirectly with the cooling shell 9 and/or make it pivotable with the part 11 of the cooling shell. The stripper 17 can be made as a separate part. The coolant 3 that exits the gap 7 can be aspirated from the stripper 17. Further, the stripper 17 can be profiled in accordance with the work roll profile.

The control or adjustment of the gap height h of the gap 7 between the roll surface and the cooling shell 9, 11 can be carried out by measurement or monitoring of the pressure p in the region of the nozzle 5. A measurement with a pressure sensor 13 arranged in the nozzle 5, enables a reliable determination of gap height h.

Generally, the measurement with the sensor 13 can take place in the gap 7 itself, in the nozzle region, or downstream of the nozzle 5, and is not limited only to the region of the nozzle 5.

Figure 2A:
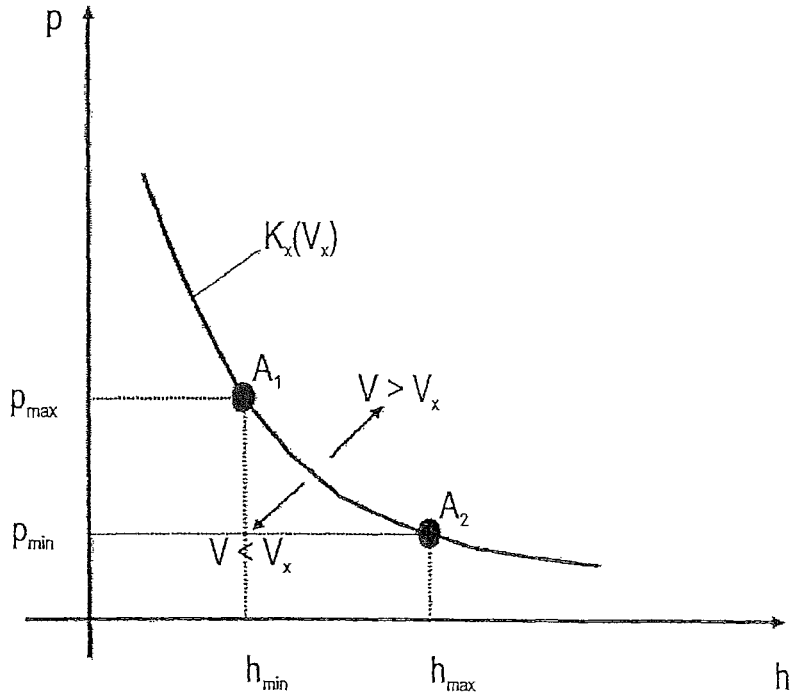
FIG. 2*a* an exemplary characteristic pressure-distance at a predetermined volume flow rate of coolant.

Advantageously, the pressure p is measured with a sensor 13 and is associated with a set distance between the cooling shell 9, 11 and the roll surface or a set height h. This association can be carried out based on the preliminary determined characteristic $K_x$. Such a characteristic $K_x$ can either be obtained by measurements or, advantageously, determined by calculations based on numerical simulation. FIG. 2*a* shows an example of a such characteristic $K_x$. The characteristic $K_x$ ($V_x$) is shown for a predetermined (given or defined) volume flow rate $V_x$ and describes a ratio between the pressure p (at the point of the pressure measurement) and the gap height h. With this characteristic $K_x$, each pressure p can be associated with the gap height h at a known volume flow rate $V_x$. If, e.g., only one volume flow rate $V_x$ is used for cooling, one characteristic $K_x$ is enough. If other or several volume flow rates $V_x$ are used, advantageously, corresponding characteristics $K_x$ need be available. The characteristic $K_x$ which is shown in FIG. 2*a* describes the course between the pressure p and the gap height h for a fixed volume flow rate $V_x$. In the shown diagram, for other volume flow rates V, which are smaller or greater than $V_x$, the characteristic will be displaced as shown by arrows. Further, an advantageous operating region between points A1 and A2 is shown. Such an operating region need not be precisely defined and is set in accordance with properties of the available installation and of the available roll, of the to be-rolled product, or the required strip thickness reduction. The illustrated preferable operating region is limited by a value pair $p_{max}$, $h_{min}$ (A1) and $p_{min}$, $h_{max}$ (A2). In particular, the rise of the characteristic in the operating region, i.e., between A1 and A2, advantageous is in order of 1 (e.g., between 1 and 10), which improves the controllability of the system in comparison with greater or smaller values. The maximum pressure $p_{max}$ can both, from the constructional point of view and from cost consideration, be reduced. The maximum gap height $h_{max}$ can also be reduced. The maximum gap height $h_{max}$ need be reduced as with a greater gap height h, a very large amount of coolant is necessary to insure an adequate cooling (in particular by a high flow velocity and/or a constant contact of the roll surface with the coolant).

Figure 2B:
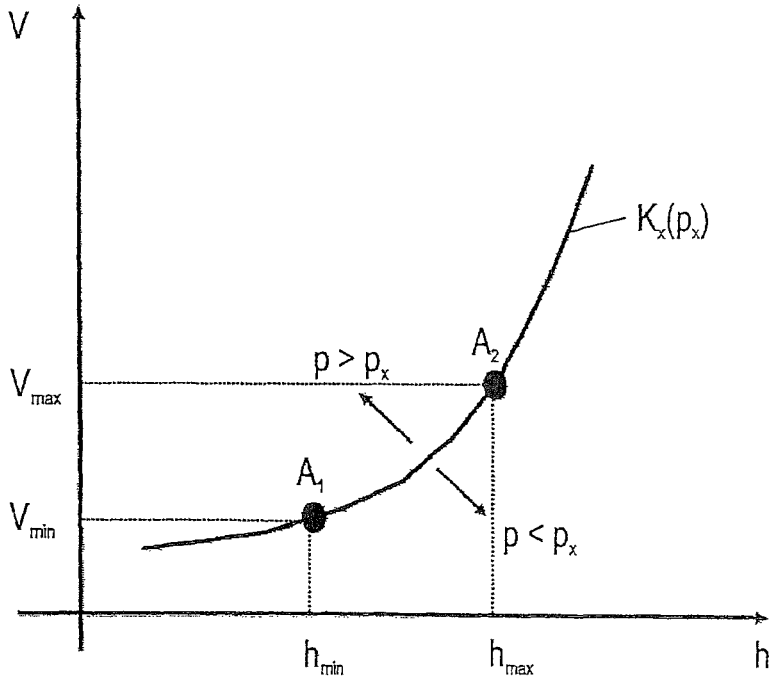
FIG. 2*b* an exemplary characteristic volume flow rate—distance at a predetermined pressure of the coolant.

Alternatively, in case of measurement of the volume flow rate V, the gap height h is set or controlled using the volume flow rate-distance characteristic $K_x$ ($p_x$). Such characteristic $K_x$ ($p_x$) is shown in FIG. 2*b*. The determination is carried out analogous as in FIG. 2*a*, however, the characteristic $K_x$ ($p_x$) is determined based on a known pressure $p_x$. The volume flow rate V is determined with regard to gap height h. If the predetermined pressure p is greater or smaller than $p_x$ is selected, the characteristic $K_x$ ($p_x$) is displaced, as shown. The further interpretation of the is analogous to the characteristic in FIG. 2*a*, except that it is the pressure p which is fixed for the characteristic $K_x$ ($p_x$), and the volume flow rate V is varied.

Naturally, it is not necessary that the characteristic $K_x$ is provided in a graphical form, rather the characteristic $K_x$ can be stored in form of value tables, matrisses, arrays, or function behavior and/or in an evaluation device, wherein the measured pressures $p_{act}$ or measured volume flow rates $V_{act}$ are associated with the gap heights $h_{act}$. This is possible to achieve automatically and during a rolling operation.

Alternatively, it is possible to so use the characteristic $K_x$ that is associated with a set height $h_{set}$, a set pressure $p_{set}$, or a set flow rate $V_{set}$. This will be described in detail with reference to FIGS. 3 and 4.

Figure 3A:
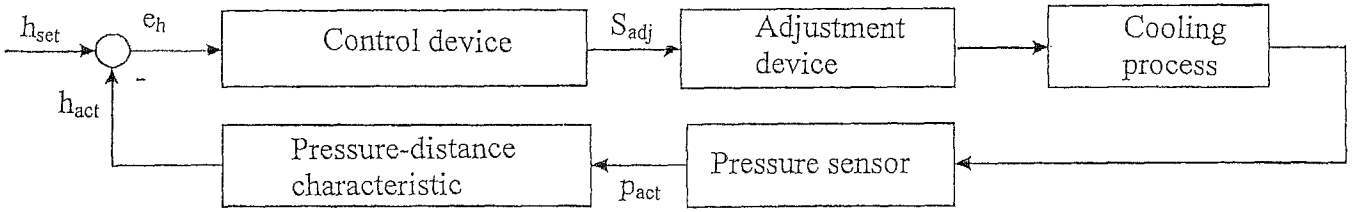
FIG. 3*a* a control diagram for controlling the gap height or the distance between the cooling shell and the roll surface using the pressure-distance characteristic.

FIG. 3*a* shows, by way of example, control or adjustment of the gap height h which, e.g., is changed by changing the position of the roll surface (disturbance value). Such position change can take place by changing rolls or by wear. It is possible to encounter not-expected jumps of the roll during operation. A given gap height leads to a given cooling medium pressure $p_{act}$ (control variable) that is determined by a pressure sensor 13 (measuring element). Using the pressure-height characteristic according to FIG. 3*a*, an (actual) height of the gap $h_{act}$ is associated with the measured (actual) pressure $p_{act}$. This height $h_{act}$ is then compared with a set value of the gap height $h_{set}$. A possible difference in between the actual and set height (control deviation) is communicated to the control element (controller). The controller generates an adjustment value S and communicates it to an adjustment device (actuator). This one correspondingly adjusts the gap height so that a desired height $h_{set}$ is again established, at least for a short time. Dependent on the design of the system, the control deviation is directly communicated to the adjustment device.

Figure 3B:
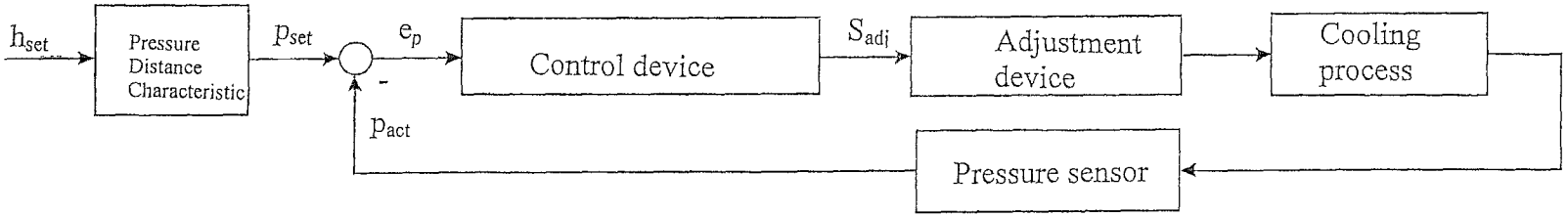
FIG. 3*b* a further possible control diagram for controlling the gap height or the distance between the cooling shell and the roll surface using the pressure-distance characteristic.

Alternatively, according to FIG. 3*b*, it is possible that the pressure sensor 13 determines the coolant pressure $p_{act}$ (control variable) and communicates the actual value to a deviation element or deviation producer, and there it is compared with a set value of the coolant pressure $p_{set}$. The set pressure $p_{set}$ can be obtained from a pressure-height characteristic wherein the set height of the gap $h_{set}$ is pre-set, and using the pressure-height characteristic, the set pressure of the coolant $p_{set}$ is associated with the set height of the gap $h_{set}$. The control deviation, which is obtained by comparison of the actual pressure pa actual with the set pressure $p_{set}$, is fed to the control device that generate an adjustment value for the adjustment device so that the gap height h is adjusted or set on the basis of the produced pressure difference $e_p$.

In cases described with reference to FIGS. 3*a* and 3*b*, it is advantageously assumed that the volume flow rate V of the coolant remains constant, and the measured coolant pressure $p_{act}$ is compared, using the pressure-height characteristic $K_x$ (corresponding to the constantly retained volume flow rate V), with a set height $h_{set}$. The produced control deviation $e_h$, $e_p$ can then be used for establishing the gap height h.

Alternatively, as shown in FIG. 4, it is possible to monitor the cooling process, using a volume flow rate meter 13 (measuring element). If the gap height h changes, the coolant volume flow rate $V_{act}$ (control variable) also changes. The measured (actual) volume flow rate $V_{act}$ can be converted, with the help of volume flow rate-distance characteristic and with known fixed pressure $p_x$, in an actual gap height $h_{act}$. Analogous to FIG. 3, the obtained, with the aid of the characteristic $K_x$, value of the actual gap height $h_{act}$ can be compared with the desired set gap height $h_{set}$. The comparison permits to obtain the control deviation $e_h$. It can be fed to a control device (controller) that, advantageously, communicate the adjustment value $S_{adj}$: to an adjustment device (actuator). The adjustment device then adjusts the gap height h so that the desired height $h_{set}$ is provided again.

Figure 4A:
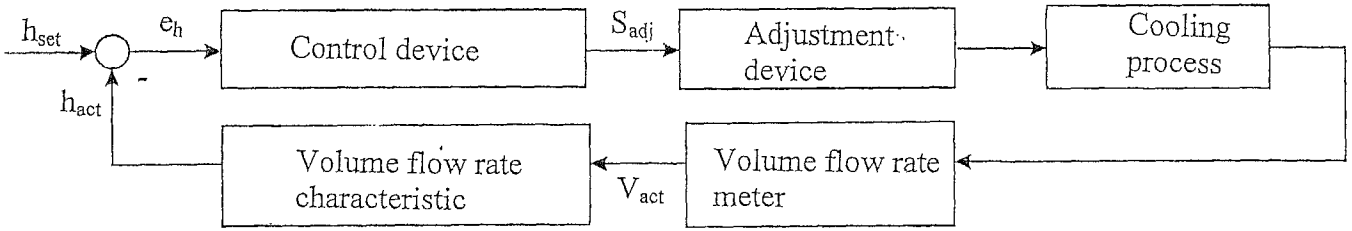
FIG. 4*a* a control diagram for controlling the gap height or the distance between the cooling shell and the roll surface using the volume flow rate-distance characteristic.
Figure 4B:
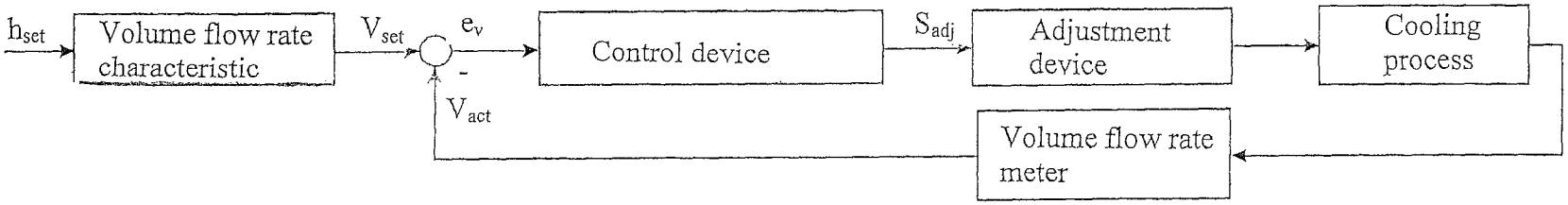
FIG. 4*b* a further possible control diagram for controlling the gap height or the distance between the cooling shell and the roll surface using the volume flow rate-distance characteristic.

Similar to description related to FIG. 3 and the measurement of the pressure, the characteristic according to FIG. 4*b* can serve to associate a set height $h_{set}$ with a set volume flow rate Vset, wherein the later can be compared with an actual volume flow rate $V_{act}$ produced by the volume-flow rate meter 13. The comparison results in a control deviation $e_r$ that then is converted by a controller in an adjustment value in order to obtain a desired actual height $h_{set}$ in accordance with the magnitude of the control deviation $e_v$.

In cases described with reference to FIGS. 4*a* and 4*b*, it is advantageously assumed that the pressure p of the coolant remains constant and the measured volume flow rate $V_{act}$ is compared, using the volume flow rate height characteristic $K_x$ ($p_x$) (corresponding to the constantly retained pressure p, with a set height $h_{set}$. The produced control deviation en can then be use for establishing the gap height h.

The above described embodiments serve first of all for a better understanding of the invention and should not be considered as limiting the invention. The scope of protection of the present patent application is defined by the claims.

The features of the described embodiments can be combined with each other and replace one another.

Further, the described features can be adapted by one of ordinary skill in the art to available facts or existing devices.

Reference Numerals and Signs

1 Roll
3 Coolant/-fluid

5 Nozzle
7 Gap
9 Cooling shell/first part of the cooling shell
10 Device for cooling a roll
11 Cooling shell/second part of the cooling shell
13 Pressure sensor/volume flow rate meter
15 Metal strip
17 Stripper
100 Rolling device
A Pivot axis
$A_1$ First operating point
$A_2$ Second operating point
D Rotational direction of the roll
$e_h$ control deviation
$e_p$ control deviation
$e_v$ control deviation
h Gap height
$h_{act}$ Actual gap height
$h_{set}$ Set gap height
U Circumferential direction of the roll
p Coolant pressure
$p_{act}$ Actual coolant pressure
$p_{set}$ Set coolant pressure
$p_{max}$ Maximum operating pressure
$p_{min}$ Minimal operating pressure
$p_x$ Pressure x (defined pressure)
$h_{max}$ Maximum gap height
$h_{min}$ Minimal gap height
V Volume flow rate
$V_{act}$ Actual volume flow rate
$V_{set}$ Set volume flow rate
$V_{max}$ Maximal volume flow rate
$V_{min}$ Minimal volume flow rate
$V_x$ Volume flow rate (defined volume flow rate)
$K_x$ Characteristic
$S_{adj}$ Adjustment value

The invention claimed is:

1. Method of cooling a roll (1) of a hot rolling installation, comprising the steps of:

feeding of a coolant (3) with a nozzle (5) in a gap (7) between at least a portion of a roll surface and a cooling shell (9, 11) mountable on the portion of the roll surface;

setting a gap height (h) between the cooling shell (9, 11) and the roll surface; and carrying out one of the following steps:

measuring a pressure ($p_{act}$) of the fed coolant and setting the gap height (h) on basis of the measured pressure ($p_{act}$); and measuring a volume flow rate ($V_{act}$) of the fed coolant (3) and setting the gap height (h) on basis of the measured volume flow rate ($V_{act}$).

2. The method according to claim 1, wherein the pressure measuring and volume flow measuring steps include, respectively, increase of the gap height (h) between the roll (1) and the cooling shell (9, 11) when the measured coolant pressure ($p_{act}$) and the measured volume flow rate ($V_{act}$) lies, respectively, above a predetermined upper threshold of the gap height (h), and reducing the gap height between the roll (1) and the cooling shell (9, 11) when the measured coolant pressure ($p_{act}$) and the measured volume flow rate ($V_{act}$) lies respectively below a predetermined lower threshold of the gap height.

3. The method according to claim 1, comprising the steps of:

in case of measuring the pressure, feeding the coolant (3) into the gap (7) with a predetermined flow volume rate (Vx) and carrying out the setting of the gap height (h) between the roll and the cooling shell in accordance with the measured coolant pressure ($p_{act}$) based on a preliminary obtained pressure-distance characteristic (Kx) for the predetermined volume flow rate (Vx) of the coolant; and in case of measuring the volume flow rate, feeding the coolant (3) into the gap (7) with a predetermined pressure ($p_x$) and carrying out the setting of the gap height (h) between the roll (1) and the cooling shell (9, 11) in accordance with the measured volume flow rate ($V_{act}$) based on a preliminary obtained volume flow rate-distance characteristic ($K_x$) for the predetermined pressure ($p_x$) of the coolant.

4. The method according to claim 3, comprising the steps of:

in case of measuring the pressure comparing the measured coolant pressure ($p_{act}$), based on the pressure-distance characteristic ($K_x$), with a predetermined set height ($h_{set}$) of the gap (7); and in accordance with amount of deviation produced by this comparison, generating adjustment value ($S_{adj}$) for setting the gap height (h); and in case of measuring the volume flow rate, comparing the measured volume flow rate ($V_{act}$), based on the volume flow rate-distance characteristic ($K_x$), with a predetermined set height ($h_{set}$) of the gap (7); and in accordance with the amount of the deviation produced by this comparison, generating an adjustment value ($S_{adj}$) for setting the gap height (h).

5. The method according to claim 3, comprising the step of obtaining the pressure-distance and volume flow rate-distance characteristics ($K_x$) by a numerical simulation or experimentally.

6. The method according to claim 4, comprising the steps of:

in case of the predetermined volume flow rate, producing the pressure-distance characteristic ($K_x$), for at least one volume flow rate ($V_x$) of the coolant (3) used for cooling the roll (1); and in case of the predetermined pressure, producing the volume flow rate-distance characteristic ($K_x$) for at least one pressure ($p_x$) of the coolant (3) used for cooling the roll (1).

7. The method according to claim 3 comprising the steps of:

in case of measuring the pressure, producing the pressure-distance characteristic ($K_x$) by association of the coolant pressure with the gap height (h) between the roll surface and the cooling shell (9, 11); and in case of measuring the volume flow rate, producing the volume flow rate-distance characteristic ($K_x$) by association of the volume flow rate with the gap height (h) between the roll surface and the cooling shell (9, 11).

8. The method according to claim 1, comprising the step of injecting the coolant from the nozzle (3) essentially parallel to a circumferential direction (U) of the roll tangentionally to the roll (1).

9. The method according to claim 1, wherein a flow direction of the coolant in the gap (7) is opposite a rotational direction of the roll (1).

10. The method according to claim 9, comprising the step of, with reference to the flow direction of the coolant (3) in gap (7), arranging a stripper (17) for stripping the coolant (3) from the roll surface at a remote end of the cooling shell (9, 11) so that only a small amount of coolant (3) reaches the metal strip (15).

11. The method according to claim 1, wherein the cooling shell (9, 11) is adjusted on the roll surface by one of tilting the cooling shell (9, 11) and by a translational movement of the cooling shell (9, 11).

12. A device (10) for cooling a work roll, comprising a cooling shell (9, 1) mountable on the roll (1), having a shape substantially complementary to a region of a roll surface, and extending at least over a portion of an axial width of the roll and at least over a portion of a circumference (U) of the roll (1);

a nozzle (5) for feeding coolant in a gap (7) between the cooling shell (9, 11) and the roll (1); and one of a pressure sensor (13) for measuring pressure of a coolant in a region of the nozzle (5) and a device for setting a gap height (h) between the cooling shell (9, 11) and the roll (1) dependent on the coolant pressure ($p_{act}$) measured by the pressure sensor (13), and a volume flow meter (13) for measuring a coolant volume flow rate in a region of the nozzle (5) and a device for setting a gap height (h) between the cooling shell (9, 11) and the roll (1) dependent on the volume flow rate ($V_{act}$) measured by the volume flow meter (13).

13. The device (10) according to claim 12, wherein the cooling shell (9, 11), viewed in a circumferential direction (U) of the roll (1), is formed of at least two parts, and both parts (9, 11) of the cooling shell (9, 11) pivot relative to each other about an axis (A) extending parallel to an axial direction of the roll (1).

14. A rolling device (100), comprising a roll (1) for rolling a metal strip (15); and a device (10) for cooling the roll (1) wherein the device (10) comprises:

a cooling shell (9, 1) mountable on the roll (1), having a shape substantially complementary to a region of a roll surface, and extending at least over a portion of an axial width of the roll and at least over a portion of a circumference (U) of the roll (1);

a nozzle (5) for feeding coolant in a gap (7) between the cooling shell (9, 11) and the roll (1); and one of:

a pressure sensor (13) for measuring pressure of a coolant in a region of the nozzle (5) and a device for setting a gap height (h) between the cooling shell (9, 11) and the roll (1) dependent on the coolant pressure ($p_{act}$) measured by the pressure sensor (13), and a volume flow meter (13) for measuring a coolant volume flow rate in a region of the nozzle (5), and a device for setting a gap height (h) between the cooling shell (9, 11) and the roll (1) dependent on the volume flow rate ($V_{act}$) measured by the volume flow meter (13).

* * * * *